US005210946A

United States Patent [19]

Monroe

[11] Patent Number: 5,210,946

[45] Date of Patent: May 18, 1993

[54] LEADING EDGE PROTECTION FOR FAN BLADE

[75] Inventor: Robert C. Monroe, Houston, Tex.

[73] Assignee: Hudson Products Corporation, Houston, Tex.

[21] Appl. No.: 941,627

[22] Filed: Sep. 8, 1992

Related U.S. Application Data

[62] Division of Ser. No. 904,935, Jun. 26, 1992, Pat. No. 5,165,859.

[51] Int. Cl.[5] ..... B23P 15/06

[52] U.S. Cl. ..... 29/889.71; 29/525.2; 29/889.1; 29/889.7; 416/224

[58] Field of Search ..... 29/889.1, 889.7, 889.72, 29/889.71, 525.1, 525.2; 416/224

[56] References Cited

U.S. PATENT DOCUMENTS 4,895,491 1/1990 Cross et al. ..... 29/889.7

5,144,825 9/1992 Burg et al. ..... 29/889.7

*Primary Examiner*—Irene Cuda

*Attorney, Agent, or Firm*—Robert J. Edwards; Michael L. Hoelter

[57] ABSTRACT

A protection element containing a spring steel strip is bent to have a greater curvature than the curvature at the leading edge of a fan blade. This protection element is then fixed to the leading edge of the fan blade over an area of maximum erosion. Rubber or another elastomer can be extruded over the strip before or after it is fixed to the fan blade or the strip can incorporate an outer hardened layer to resist erosion. Attachment of the strip to the blade is advantageously accomplished using rivets or screws at spaced locations along the blade and at the leading edge of the blade.

4 Claims, 2 Drawing Sheets

LEADING EDGE PROTECTION FOR FAN BLADE

This application is a division of application Ser. No. 07/904,935, filed Jun. 26, 1992, now U.S. Pat. No. 5,165,859.

FIELD AND BACKGROUND OF THE INVENTION

Steam generating units or petrochemical process plants require large numbers of wet cooling towers to cool water used in steam condensing or other heat exchange applications. This water is typically cooled by evaporation, such as by co-mingling with air supplied by large multi-bladed fans. In this process, some water droplets are entrained in the air and come into contact with the leading edges of the fan blades. These fan blades will generally be moving at a very high velocity, typically 125 mph at the outer-most radius of the blade, and thus, over time, damage to these blades will occur.

The most troublesome problem with the fans used in these wet cooling towers is leading edge erosion which is caused by impact with the water droplets entrained in the air stream. Severe erosion by such impact can result in the loss of these fan blades costing $1,000.00 or more in replacement costs. One technique for preventing such erosion is to apply a rubber "boot" to the leading edge of each blade in order to absorb the impact energy of colliding with the droplets. The cost of this rubber boot is approximately $200 to $500 per blade with this cost including about four hours labor for installation. Thus, when considerinq the vast number of blades to be corrected, the cost and effort involved is quite substantial.

There is also an ongoing debate as to whether the erosion problem is due to faults in the blade or due to excessive water droplets in the air which compounds the difficulty of correcting the resultant problem.

SUMMARY OF THE INVENTION

An object of the present invention is to provide improved leading edge protection for fan blades which is inexpensive and effective in reducing leading edge corrosion. The low cost and effectiveness of the invention avoids the debate concerning whether erosion is due to faults in the blade or excessive drift since the invention can be economically applied to solve the problem without addressing which factor causes the erosion.

According to the present invention, a thin gage, continuous, stainless steel spring strip is shaped to conform to the leading edge profile of the blade. Holes are punched at uniform distances along the center of the strip and a coating of rubber or other elastomer is extruded around the strip with the thickest dimension at the point of maximum erosion on the blade. The holes are utilized to fasten the strip to the leading edge of the blade in a quick, economical and effective manner.

Accordingly, another object of the present invention is to provide improved leading edge protection for fan blades which is simple in design, rugged in construction and economical to manufacture and install.

The various features of novelty which characterize the invention ar pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
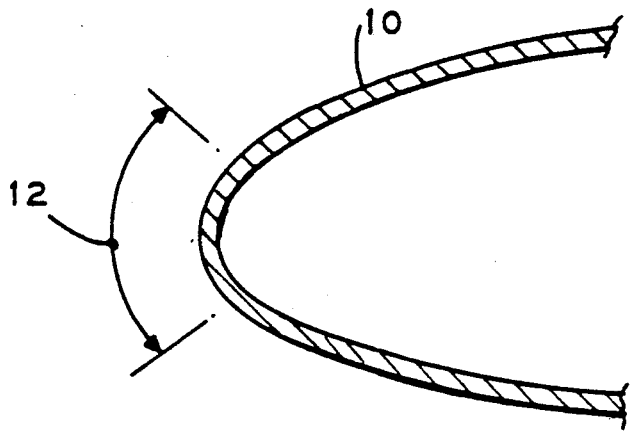
FIG. 1 is a partial sectional view of the leading edge of a fan blade the area of maximum erosion.

Referring to the drawings, and in particular FIG. 1, there is shown a typical leading edge construction of fan blade 10. The leading area of approximately 1 inch in arcuate length at 12, is exposed to maximum erosion during the useful life of blade 10.

Figure 2:
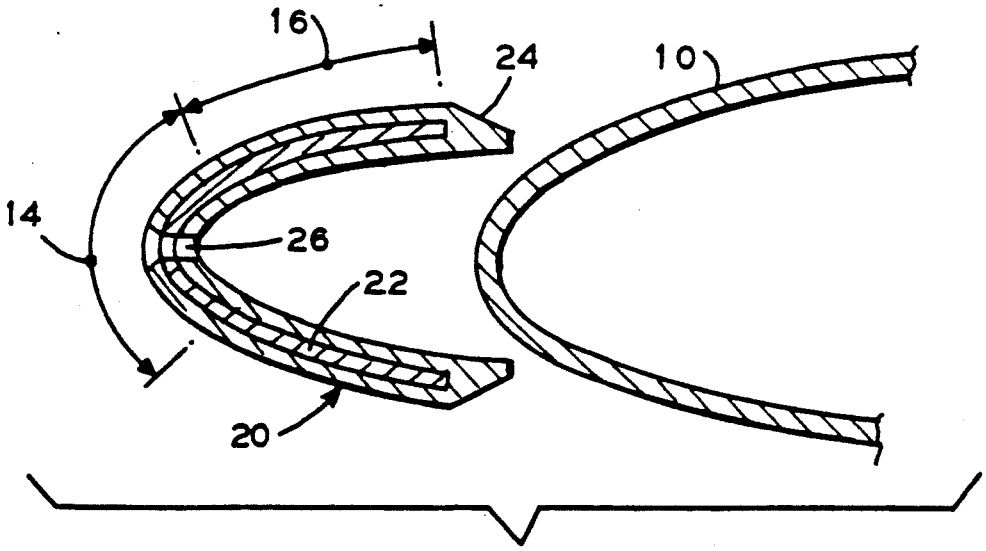
FIG. 2 is an exploded view showing the leading edge of the fan blade illustrating the leading edge protection of the present invention before it has been installed.

FIG. 2 illustrates the edge protection member of the invention which is generally designated 20. It consists of an elongated continuous thin gage stainless steel spring strip 22 surrounded by an extruded covering of rubber or other elastomer 24. The curvature of this stainless steel strip 22 is selected to match or be greater than the curvature of the leading edge of blade 10 so that with protection member 20 installed, spring steel strip 22 will squeeze or be biased tightly against and thereby grip the leading edge of blade 10. Holes 26 (one shown) are also punched through protection member 20 at spaced locations along its length, this length being normal to the plane of FIG. 2

Holes 26 can be punched into spring steel 22 before rubber 24 is extruded, followed by pilot holes or alignment markings on the surface of the rubber to indicate the location of the underlying holes. Alternatively, holes 26 may be punched after rubber 24 is extruded over stainless steel strip 22, whichever is desired. The area of high erosion protection 14 provided by member 20 is selected to match the area of high erosion 12 on blade 10, with the width of strip 22 (defined by reference numeral 16) on opposite sides of this high corrosion area, being selected to be approximately 2 to 3 inches.

Figure 3:
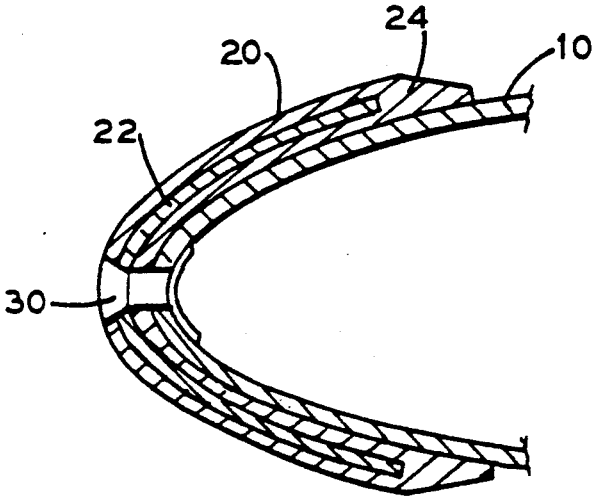
FIG. 3 is the leading edge of the fan blade with the edge protection of the present invention installed.

FIG. 3 illustrates the installed position of protection member 20 on blade 10. Stainless steel strip 22 is expanded slightly to accommodate the curvature of blade 10 and at the same time firmly hold itself and extruded rubber coating 24 against blade 10 to avoid rattling or any other displacement. A connector 30, for example a blind monel rivet or a screw, is fastened through holes 26 and the corresponding aligned holes in the leading edge of blade 10. Ideally, these holes 26 would be drilled during blade assembly to provide an entrance for the rivet through the blade laminate. Advantageously, holes 26 are provided every 8 to 10 inches (or so) on center along the radial length of blade 10 which may be 16 feet or more. Despite the drilling of such holes 26, it should be understood that this operation does not compromise the strength of blade 10.

Figure 4:
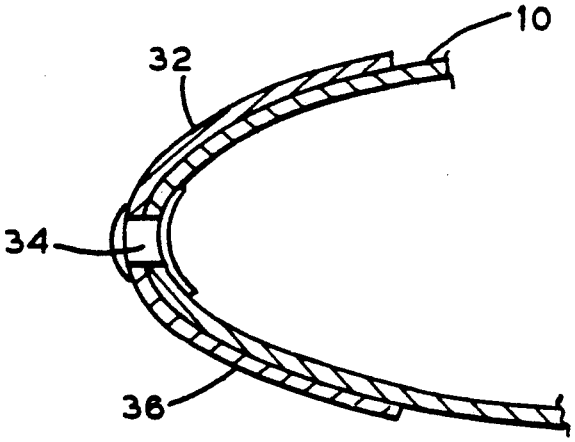
FIG. 4 is a view similar to FIG. 3 showing an alternate embodiment of invention.

FIG. 4 illustrates a second embodiment of the invention wherein edge protection member 20 comprises a stainless steel strip 32 fastened by rivet 34 at spaced locations along the axial length along blade 10. Stainless steel spring 32 is configured with a hard facing of known material 36 on its outer surface. Titanium nitride or any other known hardened layer material can qualify as layer 36. Other similar variations are also equally likely.

According to the present invention, edge protection member 20 can be installed at a rate of approximately 30 to 45 minutes per blade. This is compared to the four hours or more of installation time normally required to install the previously used boot construction. Strips 22 or 32 of edge protective member 20 can also be constructed to have a maximum thickness at the point of maximum erosion and to have a greater curvature than blade 10 so that when installed, member 20 closely hugs the outer surface of blade 10. An adhesive may also be applied between edge protection member 20 and blade 10 to further affix edge protection member 20 to blade 10 if need be.

With proper spacing between holes 26 in protection member 20 and blade 10, the invention can be advantageously applied to blades having a radial length of 16 feet or more, as well as to blades having a length less than 16 feet.

While the specific embodiments of this invention have been shown and described in detail to illustrate the application of the principles of the invention, it will be understood that the invention may be embodied otherwise without departing from such principles.

What is claimed is:

1. A method of protecting the leading edge of a fan blade having an area of maximum erosion and a selected curvature, comprising the steps of:

a. bending a continuous strip of spring steel to have a greater curvature than the curvature of the leading edge of the fan blade thereby causing said spring steel to compress against the leading edge of the fan blade when applied;

b. applying anti-erosion means over at least an external surface of said strip for preventing erosion of this said surface, said anti-erosion means comprises extruding an elastomer over said strip before fixing said strip to the blade;

c. pressing said strip onto the blade by at least partly biasing said strip so that when released, said strip tightly grips or compresses against an outer surface of the blade; and d. permanently fixing said strip to the leading edge of the blade.

2. A method according to claim 1, wherein said elastomer is rubber.

3. A method according to claim 2, including providing a plurality of spaced holes along said strip and fixing said strip to the hollow blade using rivets or screws.

4. A method according to claim 2, wherein said anti-erosion means comprises a hard outer layer applied to said strip on the surface of said strip which is away from the blade.

* * * * *